US005484229A

United States Patent [19]

Reece

[11] Patent Number: 5,484,229

[45] Date of Patent: Jan. 16, 1996

[54] ROAD REPAIRING SYSTEM AND APPARATUS

[76] Inventor: Roger R. Reece, 9415 E. 500 South, Upland, Ind. 46989

[21] Appl. No.: 220,737

[22] Filed: Mar. 31, 1994

[51] Int. Cl.[6] ..... E01C 19/22

[52] U.S. Cl. ..... 404/110; 404/118

[58] Field of Search ..... 404/78, 107, 108, 404/110, 119, 118; 296/184; 298/7, 1 R, 23 TT, 1 B

[56] References Cited

U.S. PATENT DOCUMENTS

| | | | |
|---|---|---|---|
| 2,878,053 | 3/1959 | Yuncker | 298/7 |
| 3,035,499 | 5/1962 | Domenighetti | 404/105 |
| 3,095,788 | 7/1963 | Odell | 404/110 |
| 3,439,593 | 4/1969 | Torman | 94/44 |
| 3,636,831 | 1/1972 | Davin et al. | 94/45 R |
| 3,771,893 | 11/1973 | Miller | 404/101 |
| 3,877,830 | 4/1975 | James, III | 404/84 |
| 3,881,764 | 5/1975 | Holland | 296/184 |
| 4,102,590 | 7/1978 | Zanzie | 404/110 |
| 4,194,854 | 3/1980 | Mauldin | 404/110 |
| 4,215,949 | 8/1980 | Gabriel, Jr. | 404/110 |
| 4,216,838 | 8/1980 | Degraeve et al. | 180/14 R |
| 4,311,408 | 1/1982 | Wren | 404/104 |
| 4,571,119 | 2/1986 | Jones et al. | 404/96 |
| 4,676,689 | 6/1987 | Yant | 404/110 |
| 4,678,364 | 7/1987 | Charonnat et al. | 404/105 |
| 4,678,365 | 7/1987 | Ban et al. | 404/118 |
| 4,704,046 | 11/1987 | Yant | 404/109 |
| 4,749,304 | 6/1988 | Craig | 404/101 |
| 4,778,305 | 10/1988 | Ritchey et al. | 404/105 |
| 4,780,022 | 10/1988 | Ohiba et al. | 404/90 |
| 4,801,218 | 1/1989 | Musil | 404/84 |
| 4,828,429 | 5/1989 | Kirchner et al. | 404/111 |
| 4,830,553 | 5/1989 | Miller | 404/101 |
| 4,861,191 | 8/1989 | Smith et al. | 404/104 |
| 4,863,310 | 9/1989 | Reed | 404/104 |
| 4,900,185 | 2/1990 | Foertsch | 404/104 |
| 5,046,888 | 9/1991 | King | 404/108 X |
| 5,073,063 | 12/1991 | Brown | 404/101 |
| 5,120,155 | 6/1992 | Sampson | 404/110 |
| 5,158,394 | 10/1992 | Bresnahan | 404/108 |
| 5,397,200 | 3/1995 | Seal | 404/118 |

FOREIGN PATENT DOCUMENTS

| | | | |
|---|---|---|---|
| 1030510 | 3/1953 | France | 298/7 |

OTHER PUBLICATIONS

Blaw–Knox Consturction Equipment Corporation, Paver/Finisher Pf–161, Advertising brochure, 1993, 6 pages.

Midland Machinery Co., Inc., Widener Attachment Advertising brochure, 1993, 4 pages.

Midland Machinery Co., Inc., Shoulder Maintainence (SM), advertising brochure, 1993, 2 pages.

*Primary Examiner*—William P. Neuder

*Attorney, Agent, or Firm*—Willian Brinks Hofer Gilson & Lione

[57] ABSTRACT

The invention relates to a system and apparatus for use with a vehicle having a dump bed for carrying a material and having a moveable panel defining an outlet in the dump bed for dispensing material carried in the dump bed to a road surface when the dump bed is raised, comprising a baffle positioned in the dump bed extending upwardly from a floor of the bed, and extending from a region of the moveable panel to a region of a wall of the bed for directing the material to a portion of the outlet as gravitational force acts on the material when the dump bed is raised. Such system and apparatus may further include a receptacle coupled to the vehicle for receiving a flow of the material passing through the portion of the outlet and having a variable opening for dispensing controlled amounts of the material to the surface. Such system and apparatus may further include a leveling sled for leveling the material after the material leaving the dump bed reaches the road surface.

16 Claims, 7 Drawing Sheets

ROAD REPAIRING SYSTEM AND APPARATUS

FIELD OF THE INVENTION

The present invention relates to a system and apparatus for repairing roads and, more particularly, to a system and apparatus for repairing paved road surfaces, such as asphalt road surfaces, and the like.

BACKGROUND OF THE INVENTION

Paved road surfaces tend to deteriorate over time due to the affects of weather and traffic. This deterioration of a paved road surface, or pavement, can result in holes in the pavement which are commonly known as potholes, or chuckholes. If left unrepaired, these potholes can become serious road hazards.

Potholes in pavement are typically caused by repeated freezing and thawing of water in or under the road surface, which in turn causes the road surface to buckle and break, and results in a weakened region in the pavement. As vehicular traffic crosses the weakened region of the pavement, the broken pavement is displaced due to the weight of the vehicles pressing down on the weakened pavement. This deterioration is further accelerated by the impact of the vehicle wheels entering the region where the pavement has been displaced. At times, potholes can be so numerous that it is difficult for road repair workers to keep the pavement in acceptable condition. If left in a state of disrepair, however, such deterioration can progress to a point of requiring entire sections of the pavement to be replaced, or can result in road hazards capable of causing damage to vehicles, or causing accidents. Thus, it is desirable to repair the potholes in a timely manner.

Typically, potholes are repaired by hauling hole filling materials, such as asphalt, to the hole site with a dump truck and by manually shoveling the filling material into the hole. If desired, the fill material may be compressed in the hole by driving the wheels of the dump truck or a rolling machine over the filling material which was previously placed in the hole. Such an approach is labor intensive, and generates potential health risks to the road repair worker who must work in close proximity to a heated filling material which could cause burns and may emit noxious fumes.

Various attempts have been made to make road repair workers more efficient in repairing road surfaces. Many such attempts have focused on systems which include an auger or conveyor belt to transport the asphalt from the dump truck to the repair site. Such systems are expensive, include moving parts which are subject to wear and breakage, and expose the road repair worker to the further potential health risks posed by the moving parts of the system.

Therefore, a need exists for an improved system and apparatus for repairing road surfaces.

SUMMARY OF THE INVENTION

The present invention relates to a system and apparatus used with a vehicle having a bed for carrying a material and having a moveable panel defining an outlet in the bed for dispensing material to a surface, including a directing device positioned in the dump bed for directing the material to a portion of the outlet as gravitational force acts on the material to cause movement of the material when a front portion of the bed is raised with respect to a rear portion of the bed, a control device coupled to the vehicle for controlling an amount of the material passing through the portion of the outlet that is dispensed to said surface, and a leveling device coupled to the vehicle for leveling the material dispensed to the surface.

Preferably, the directing device includes a baffle mounted in the bed extending upwardly from a floor of the bed, and extending from a region of the moveable panel to a region of a wall of the bed. The baffle directs the material to the portion of the outlet as gravitational force acts on the material when a front of the bed is raised with respect to a rear of the bed. Viewed in another way, the baffle extends outwardly from a side of the bed and extends upwardly from a floor of the bed wherein the baffle, the side, the moveable panel and the floor define a volume in the bed substantially void of the material. The shape of a cross-section of this volume taken substantially parallel to the floor of the bed is substantially triangular.

Also, preferably, the control device comprises a hopper for receiving a flow of the material passing through the portion of the outlet. The hopper comprises a variable opening for dispensing a controlled amount of the material to the surface.

Still further, preferably, the leveling device comprises a sled having an adjusting mechanism for selecting a leveling height of the material above the surface. The sled comprises a first side member, a second side member, a rear member extending horizontally between a rear portion of each of the side members, a first elongated support adjustably coupled to the first side member, and a second elongated support adjustably coupled to the second side member. The sled may further include a platform coupled to the first and second side members for supporting an operator.

Viewed in another way, the leveling device comprises a first side member, a second side member, a rear member extending horizontally between a rear portion of each of the side members, a first elongated support adjustably coupled to the first side member, a second elongated support adjustably coupled to the second side member, and a platform coupled to the first and second side members for supporting an operator, wherein the first side member and the second side member define an opening for receiving the material after the material reaches the surface.

Although the invention described above includes a directing device, a control device, and a leveling device, certain aspects of the invention may be practiced separately from other aspects of the invention. For example, the directing device, control device or the leveling device may be used independently from each other. Likewise, the directing device and the control device together may be used independently from the leveling device.

In this respect, the invention relates to a system and apparatus for use with a vehicle having a dump bed for carrying a material and having a moveable panel defining an outlet in the dump bed for dispensing material carried in the dump bed to a surface when the dump bed is raised, including a baffle positioned in the dump bed extending upwardly from a floor of the bed, and extending from a region of the moveable panel to a region of a wall of the bed for directing the material to a portion of the outlet as gravitational force acts on the material when the dump bed is raised. This system and apparatus may further include a receptacle coupled to the vehicle for receiving a flow of the material passing through the portion of the outlet and having a variable opening for dispensing controlled amounts of the material to the surface. Still further, this system and apparatus may include a leveling sled for leveling the material after the material leaving the dump bed reaches the surface.

In another embodiment of the invention, the baffle of the invention is incorporated into the structure of a dumping bed for a vehicle to form a containment region for a material having a floor and five walls defining a polygonal structure extending upwardly from the floor wherein one of the walls is moveable to provide an outlet for the material and wherein one of the five walls is positioned at an obtuse angle with respect to the moveable wall and at an obtuse angle with respect to one of the remaining three walls. The dumping bed may further include a receptacle coupled to the bed for receiving a flow of the material as the bed is dumped and having a variable opening for varying an amount of the material reaching a road surface.

Other features and advantages of the invention may be determined from the drawings and detailed description of the invention that follow.

DETAILED DESCRIPTION OF PREFERRED EMBODIMENTS

Figure 1:
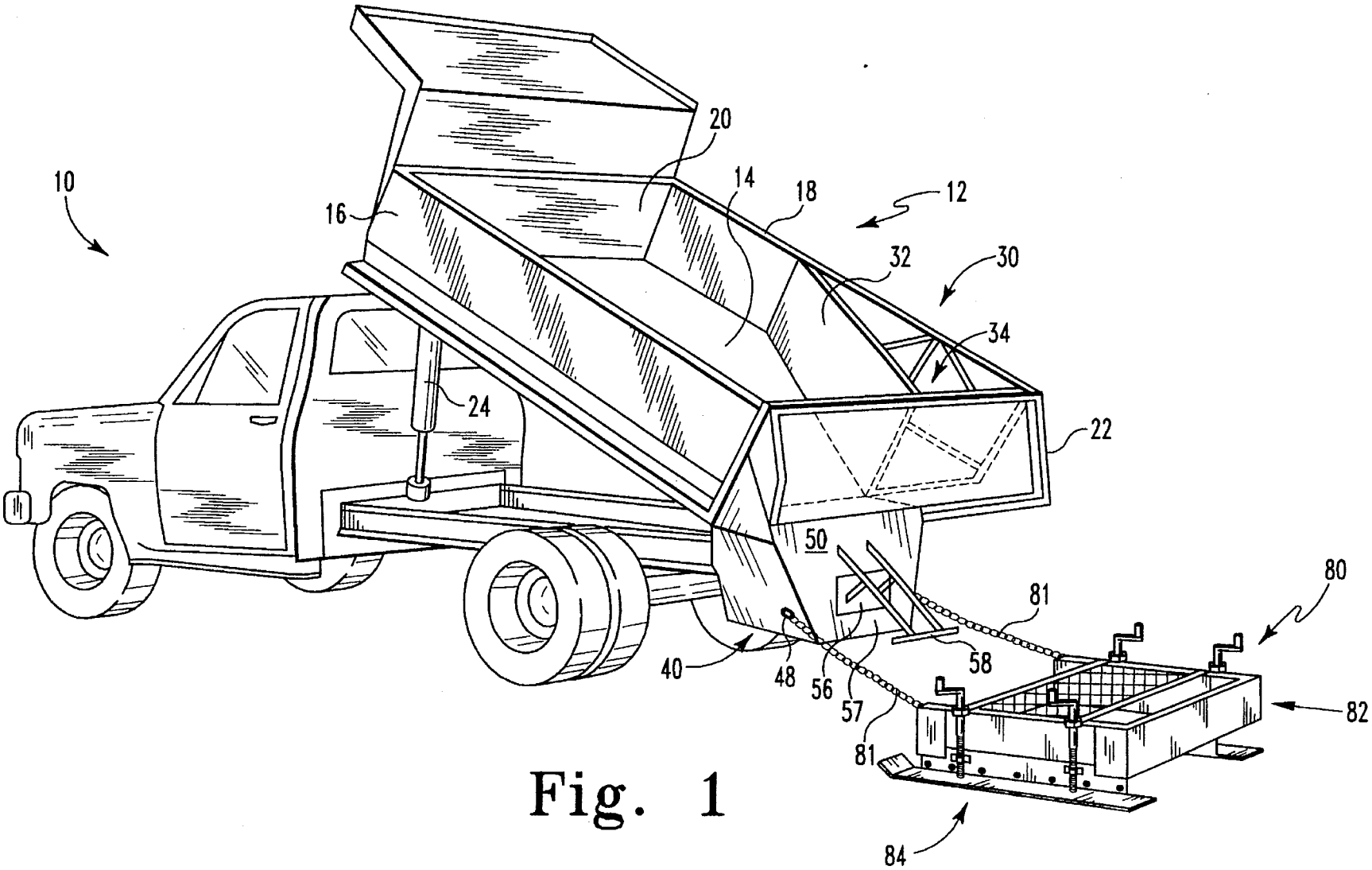
FIG. 1 shows a perspective illustration of a dump truck and apparatus of the invention.

FIG. 1 shows a perspective illustration of a vehicle, or dump truck, 10 with the apparatus of the invention coupled thereto.

As shown in FIG. 1, dump truck 10 includes a conventional dumping bed 12 for carrying a road patching material, such as asphalt. Bed 12 defines a containment region for the patching material and includes a floor 14, a left side wall 16, a right side wall 18, a front wall 20 extending horizontally between a front portion of left side wall 16 and a front portion of right side wall 18, and a moveable panel, or tailgate, 22 extending horizontally between a rear portion of left side wall 16 and a rear portion of right side wall 18. Each of the walls 16, 18, and 20 extends substantially perpendicularly upwardly from floor 14. Tailgate 22 defines an outlet in bed 12 extending between left side wall 16 and right side wall 18 for dispensing material to a road surface. Tailgate 22 is pivotally mounted to an upper rear portion of each of the side walls 16,18, and is shown in FIG. 1 in its open, or dumping, position. Bed 12 is raised into a dumping position by actuating a hydraulic cylinder 24, which is part of a standard hydraulic hoist system well known in the art, to raise a front portion of bed 12 with respect to a rear portion of bed 12.

Positioned in the dump bed 12 in a rear corner formed by right side wall 18 and tailgate 22 is a directing device 30, including a baffle 32, for directing the material carried in bed 12 to a portion of the conventional outlet formed in bed 12 by tailgate 22 as gravitational force acts on the material to cause movement of the material when bed 12 is raised to a dumping position. Thus, as shown in FIG. 1, baffle 32 is positioned in bed 12 to direct material carried in bed 12 toward a left side portion of bed 12 as bed 12 is raised. A material flow control device 40 is coupled to a rear portion of truck 10 for receiving the material passing through the portion of the conventional outlet in bed 12 as directed by directing device 30 and controlling an amount of the material which is dispensed. A leveling device 80 is coupled to dump truck 10 for leveling the material which passes through material flow control device 40 to fill a pothole or to repave a narrow section of a road surface.

Preferably, directing device 30 is positioned in the rear corner of bed 12 resting on floor 14, resting against right side wall 18 and resting against tailgate 22 without any form of permanent or temporary attachment to bed 12. Alternatively, directing device 30 may be removably mounted in bed 12 using conventional fastening means, such as bolts, screws, or clamps; of courage, baffle 32 may be more permanently mounted in bed 12 by welding or riveting directing device 30 to bed 12. As shown in FIG. 1, directing device 30 includes a baffle 32 which extends upwardly from floor 14 of bed 12, and extends from a mid-region of tailgate 22 to a mid-region of right side wall 18 of bed 12. Although baffle 32 is positioned at the "mid-region" of right side wall 18 and the "mid-region" of tailgate 22, one of ordinary skill in the art will recognize that the exact position of baffle 22 with respect to right side wall 18 and tailgate 22 is a matter of design choice and may be positioned at any desired location between the ends of right side wall 18 and tailgate 22.

Since baffle 32 extends outwardly from right side wall 18 of bed 12 and extends upwardly from floor 14 of bed 12, then floor 14, right side wall 18, tailgate 22 and baffle 32 define a volume 34 in bed 12 which is substantially void of material carried in bed 12. As shown in FIG. 1, the shape of a cross-section of volume 34 taken substantially parallel to the floor of the bed is substantially triangular.

Also, alternatively, if desired, directing device 30 may be inverted and positioned adjacent to left side wall 16.

Figure 2:
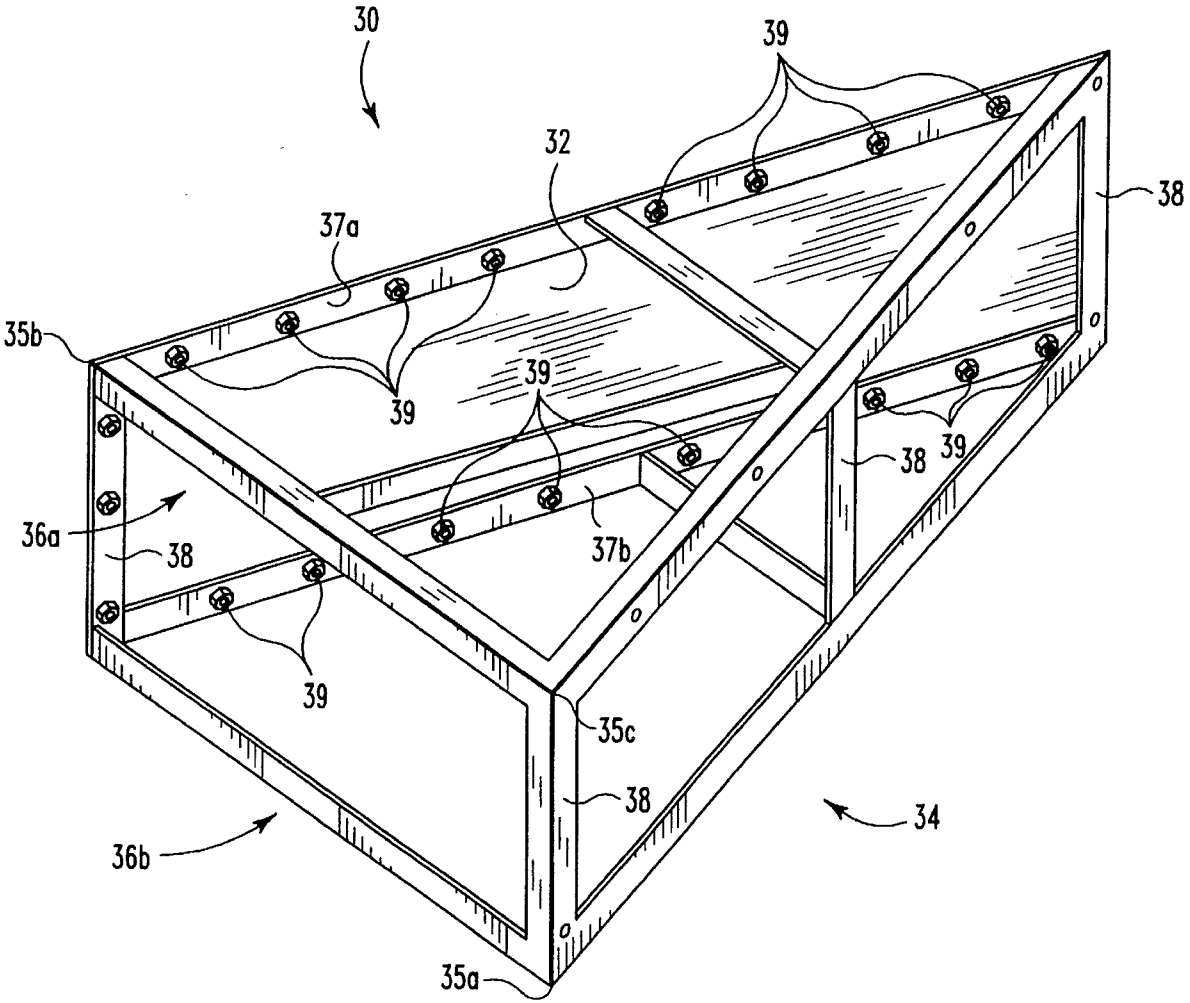
FIG. 2 shows a perspective illustration of the directing device of the invention.

FIG. 2 shows a preferred embodiment of directing device 30 of FIG. 1. Directing device 30 includes baffle 32 coupled to a frame 34. Frame 34 can be constructed from any suitable frame building material, such as angle-iron, tubular metal or metal plate, such as steel or aluminum, and the like. Frame 34 is constructed so that a corner 35 of frame 34 may be positioned adjacent the inside corner formed in bed 12 by floor 14, right side wall 18, and tailgate 22 (when closed) as shown in FIG. 1. Frame 34 includes two substantially right-triangular frame portions **36*a* and 36*b* having mounting portions 37*a* and 37*b*, respectively, forming the hypotenuse of the respective triangular frame portions 36*a*, 36*b*. The right-triangular frame portions 36*a*,36*b* are positioned substantially parallel to each other and are spaced apart by spacers 38. Preferably, right-triangular frame 36*a* is smaller than right-triangular frame 36*b* so that a corner 35*b* and a corner 35*c* of directing device 30 are spaced a distance, such as 4 inches, away from a top portion of tailgate 22 to allow for the opening of tailgate 22. As shown in FIG. 2, baffle 32 is fastened to frame 34 by bolts 39**; however, any conventional fastening means may be used, such as for example, weld, screws, rivets, etc.

As shown in FIGS. 1 and 2, baffle 32 of directing device 30 may be constructed of metal plate, such as steel or aluminum, and the like. Preferably, baffle 32 is a flat rectangular steel plate having a thickness of about one-eighth inch and is coupled to frame 34 so that baffle 32 is substantially perpendicular to floor 14 when directing device 34 is inserted into bed 12; however, it is contemplated that baffle 32 could have other shapes, dimensions, or orientations without departing from the spirit of the invention. For example, it is contemplated that baffle 32 could be curved rather than flat, or baffle 32 could be constructed of a plurality of plates in which at least one of the plates is not orientated at 180 degrees with respect to the other plates. As a further example, it is contemplated that right-triangular frame portions 36*a*,36*b* of frame 34 may be non-symmetrical so that baffle 32 can be orientated to not be substantially perpendicular to floor 14 of bed 12 as shown in FIG. 1 (i.e. positioned at a slant with respect to floor 12). Of course, changes in the shape and orientation of baffle 32 would require corresponding changes in the shape and size of frame 32.

Figure 3A:
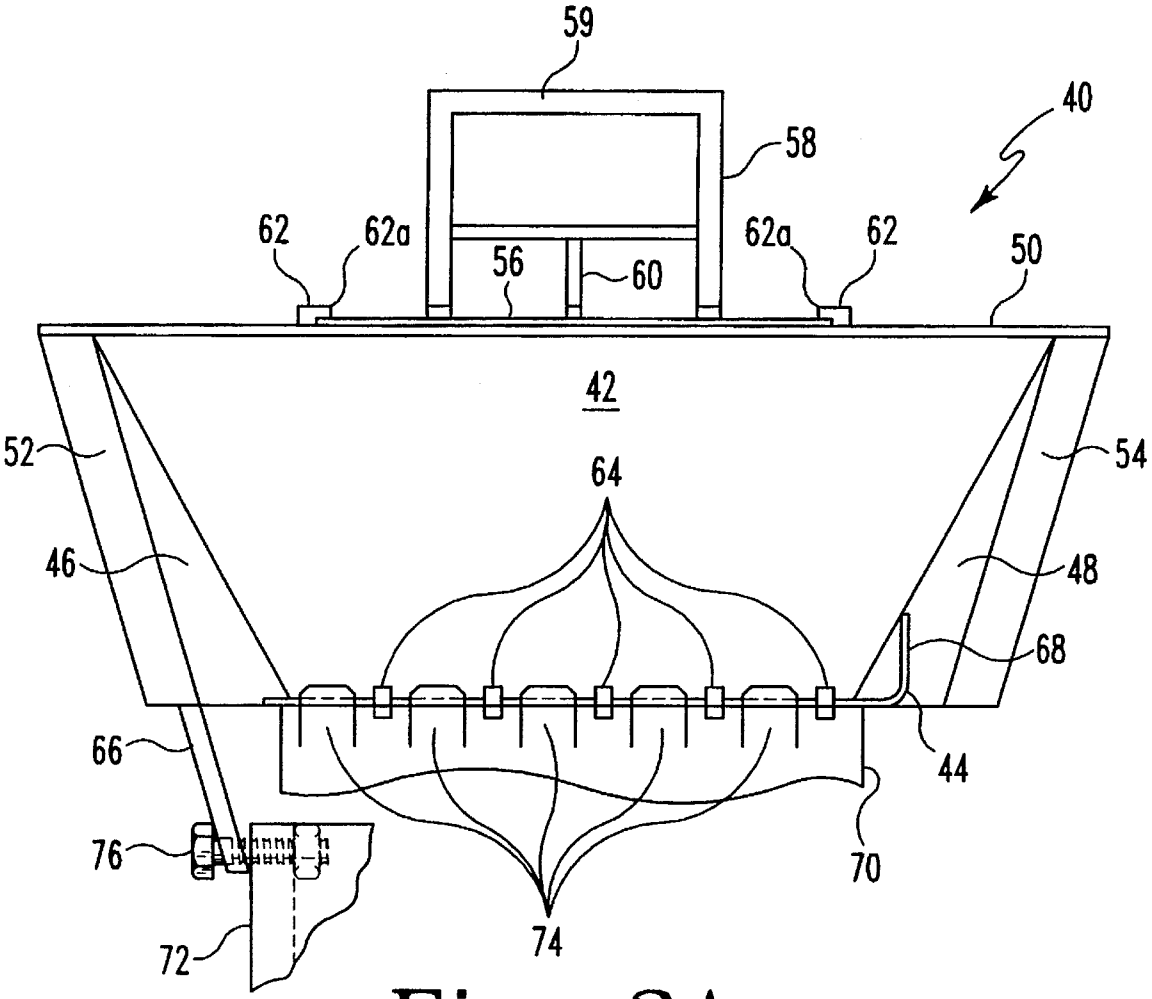
FIG. 3A shows a top view of the material flow control device of the invention.
Figure 3B:
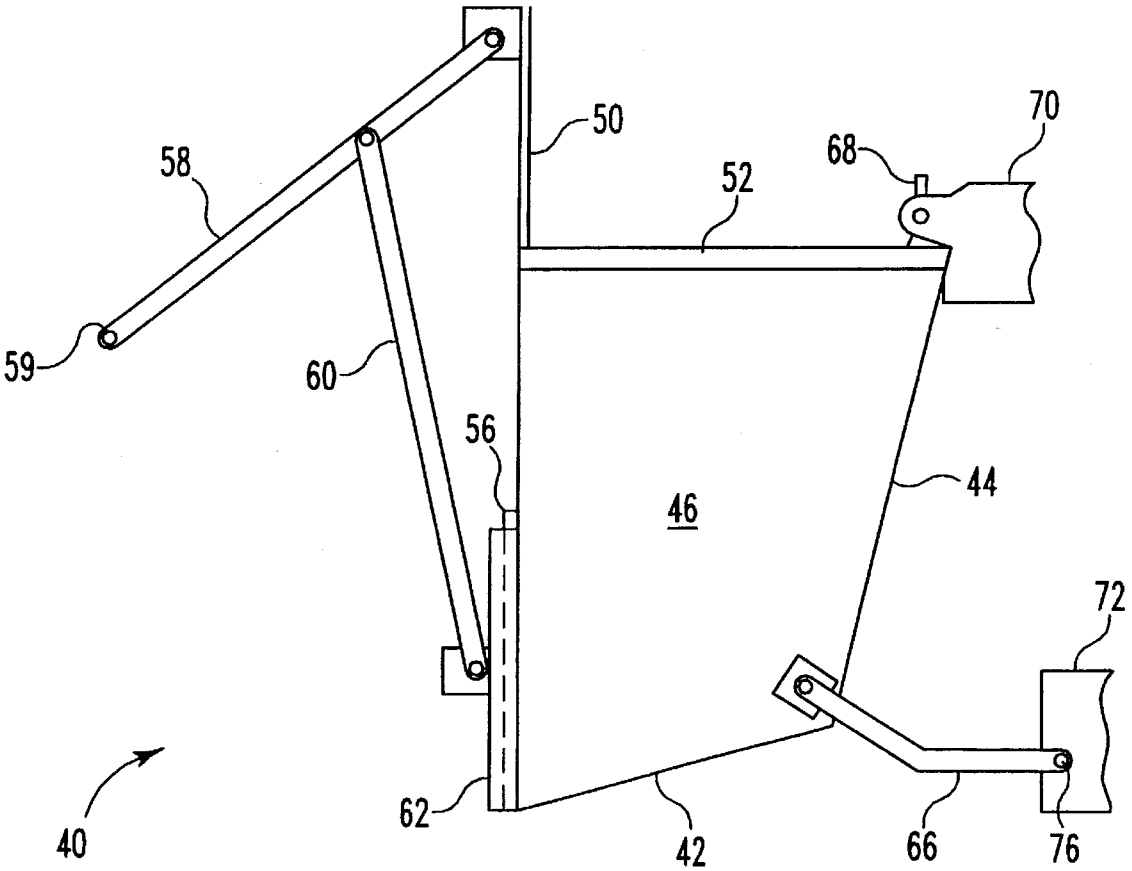
FIG. 3B shows a side view of the material flow control device of the invention.

FIGS. 3A and 3B show a top view and a side view, respectively, of material flow control device, or hopper, 40. Hopper 40 includes a base 42, a front panel 44, a right side panel 46, a left side panel 48, a rear panel 50, a right material guide 52, a left material guide 54, a gate 56, a gate actuation member 58, a gate linkage 60, a pair of gate guides 62, a plurality of upper hopper mounts 64, and a hopper mount linkage 66. Front panel 44, right side panel 46, left side panel 48, and rear panel 50 extend upwardly and flare outwardly from base 42 to form a receptacle having an open top for receiving material dumped into hopper 40 from bed 12. Right and left material guides 52 and 54, respectively, are mounted to an upper edge of the of right and left side panels 46 and 48, respectively, to provide a funneling extension for the upper portion of hopper 40. Hopper 40 is constructed so that when hopper 40 is installed on truck 10, base 42 is slanted rearwardly to encourage material entering the open top to flow toward gate 56.

As is partially shown in FIG. 1, rear panel 50 includes a rectangular void near the bottom of rear panel 50. Together, the rectangular void of rear panel 50 and gate 56 define a variable size outlet 57 for controllably dispensing material loaded into hopper 40. Referring also to FIGS. 3A and 3B, gate guides 62 are mounted to the outside surface of rear panel 50 to the right and to the left of the rectangular void. Gate 56 is slidably positioned between gate guides 62 and rear panel 50. Each of the guides 62 preferably include a lip portion 62*a* for preventing an outward thrusting motion of gate 56 when gate 56 is actuated.

Gate 56 is positioned adjacent the rectangular void of rear panel 50 to cover the rectangular void when gate 56 is in the closed position as shown in FIG. 3B. As shown in FIGS. 3A and 3B, gate actuation member 58 is pivotally coupled to a top portion of rear panel 50. Gate linkage 60 is pivotally mounted to and between a mid-region of gate actuation member 58 and a mid-region of gate 56. Thus, gate 56 is raised to increase the size of outlet 57 shown in FIG. 1 by applying an upward force to a handle portion 59 of gate actuation member 58, and is lowered to decrease the size of outlet 57, or close outlet 57, by applying a downward force to handle 59 of gate actuation member 58.

As shown in FIGS. 3A and 3B the plurality of upper hopper mounts 64 are coupled to an upper portion of front panel 44 and hopper mount linkage 66 is coupled to a lower portion of right side panel 46. Upper hopper mounts 64 each include a hole passing through the mount, and the holes of hopper mounts 64 are aligned at their centers for receiving a mounting rod 68.

In order to mount hopper 40 to truck 10, the frame of truck 10 must be retrofitted with a plurality of mounting members having holes which can be aligned with the holes of hopper mounts 64 to receive mounting rod 68. FIGS. 3A and 3B show an upper frame mount 70 and a lower frame mount 72 broken away from truck 10 for clarity. Upper frame mount 70 includes a plurality of mounting members 74, each having a hole drilled therethrough for receiving mounting rod 68. Lower frame mount 72 includes a hole for receiving a mounting pin 76.

To install hopper 40 onto truck 10, hopper 40 is raised to a position so that the holes of hopper mounts 64 are aligned with the holes of the frame mounting members 74. Once alignment is achieved, mounting rod 68 is inserted into the aligned holes. After mounting rod 68 has been inserted, then hopper 40 is rotatably positioned to align the hole in an end of hopper mount linkage 66 and the hole in lower frame mount 72. Once alignment is achieved, mounting pin 76 is inserted through the holes and secured by a suitable retainer clip, or a bolt and nut may be substituted for pin 76 and the retainer clip.

Removal of hopper 40 from truck 10 is achieved by reversing the installation process.

Figure 4A:
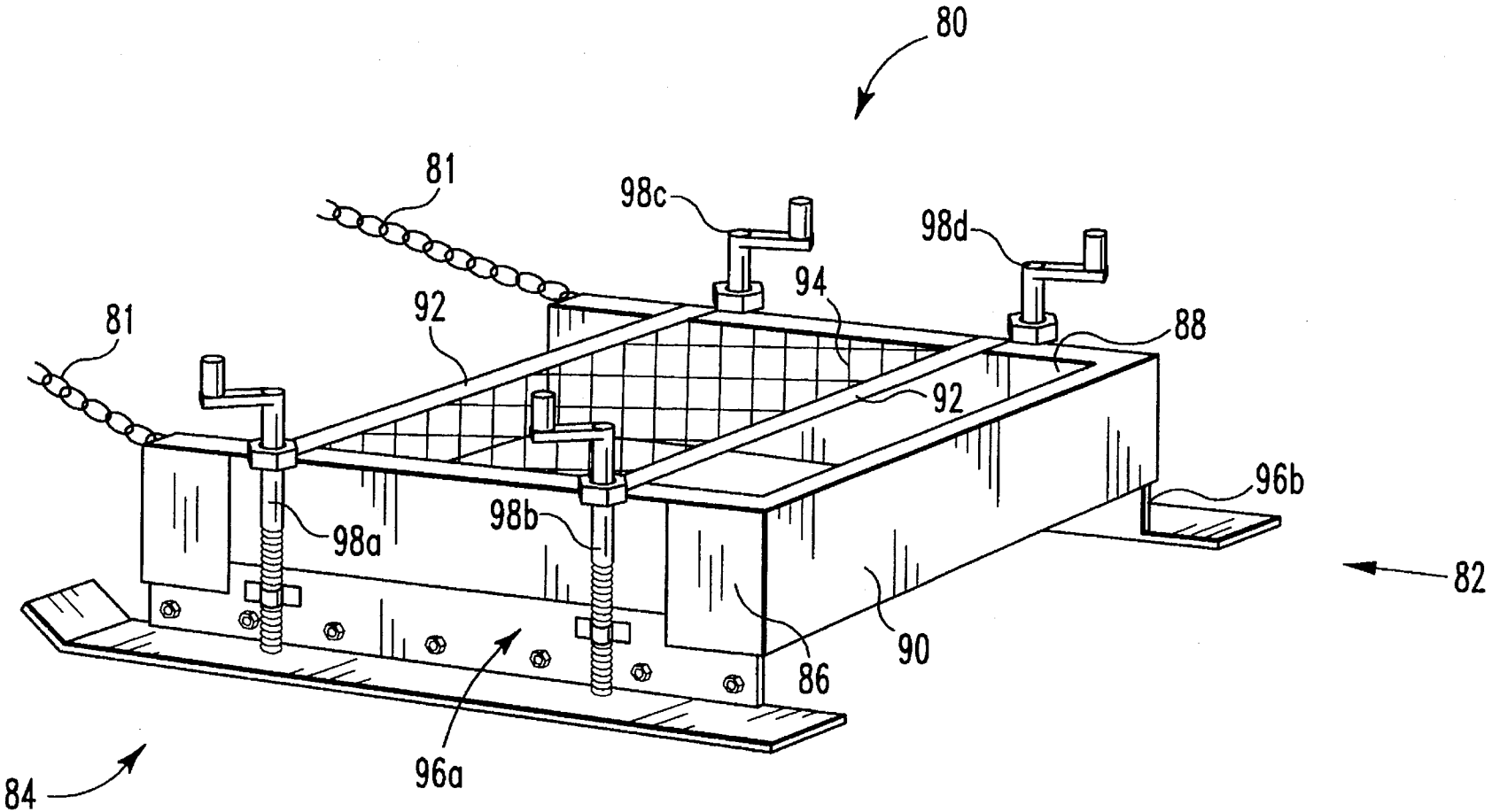
FIG. 4A shows an enlarged perspective illustration of the leveling device of the invention shown in FIG. 1.

As shown in FIG. 1, leveling device, or sled, 80 is coupled to truck 10 by a pair of chains 81 and is pulled behind truck 10 to level the material dispensed to the road surface through variable opening 57 of hopper 40. As shown in FIGS. 1 and 4A, sled 80 includes a frame 82 having an open front for receiving pothole filling material as sled 80 is pulled across the material on the road surface. Frame 82 also includes a substantially closed rear portion which engages the material to distribute the material at a uniform height with respect to the road surface. An adjusting support 84 is provided for selecting a leveled height of the material above the surface.

Figure 4B:
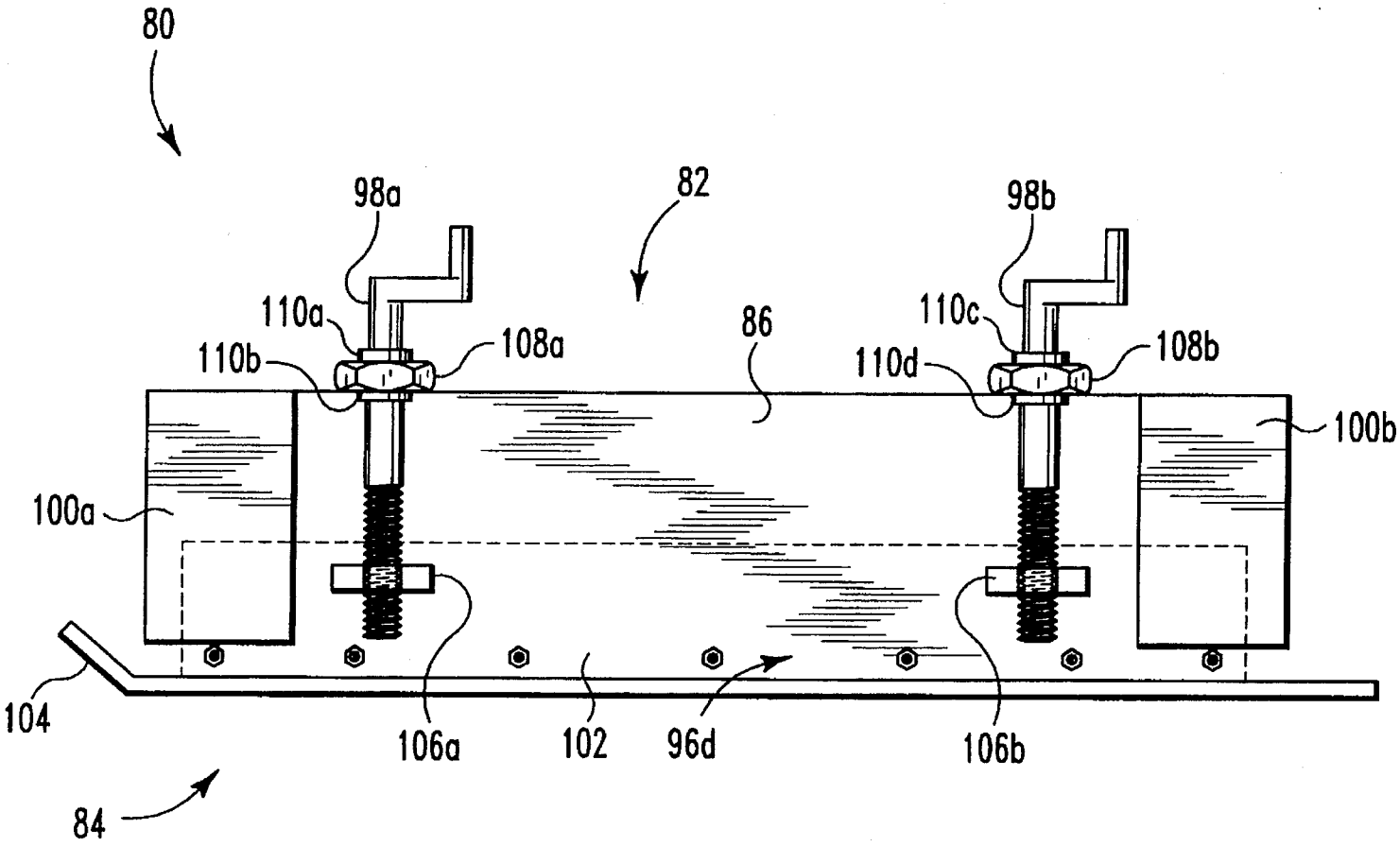
FIG. 4B shows a side view of the leveling device of the invention.

The detail of the construction and adjustment of sled 80 is more clearly shown in FIGS. 4A and 4B. As shown in FIG. 4A, frame 82 of sled 80 includes a left side member 86, a right side member 88 orientated substantially parallel to left side member 88, and a rear member 90 extending horizontally between a rear portion of each of the left and right side members 86, 88. Rigidity is provided for frame 82 by a pair of supports 92 which are position substantially parallel to rear member 90 and extend horizontally between left side member 86 and right side member 88 at spaced locations. To provide further rigidity for frame 82, as well as provide a support for an operator, a platform 94, such as metal grating, is mounted to the upper portions of left and right side members 86, 88 and between supports 92.

Adjusting support 84 includes substantially symmetrical left and right support sections 96*a*, 96*b* and a plurality of adjustment cranks 98*a*, 98*b*, 98*c*, and 98*d*. Adjustment cranks 98*a*, 98*b*, 98*c* and 98*d* may be adjusted individually or collectively to select the desired orientation and height of rear member 90 with respect to the road surface. Due to the symmetry between left and right support sections 96*a* and 96*b*, the construction of support sections 96*a* and 96*b* is substantially similar; likewise, the mounting of support sections 96*a* and 96*b* to frame 82 is substantially similar. Therefore, the construction and adjustment of support 84 will now be described with respect to the left side view of sled 80 shown in FIG. 4B with the understanding that the following discussion pertaining to the left side of sled 80 is equally applicable to the right side of sled 80.

FIG. 4B shows a left side of adjusting support 84 coupled to the left side member 86 of sled 80. Attached near a front portion of side member 86 is a metal plate 100*a*. Attached near a rear portion of side member 86 is a metal plate 100*b*. Plates 100*a* and 100*b* are spaced a sufficient distance from side member 86 to form a pair of slots for receiving and guiding a slidable member 102 of support section 96*a*. An elongated edge of slidable member 102 is attached to an elongated support sled runner 104. Preferably, sled runner 104 is bolted to slidable member 102 so that sled runner 104 may be easily replaced.

Attached to an outer surface of slidable member 102 is a pair of adjustment members 106*a* and 106*b* which extend horizontally outward from slidable member 102. Adjustment members 106*a*, 106*b* each include a vertical threaded hole therethrough for receiving a threaded portion of cranks 98*a* and 98*b*, respectively. Bearing members 108*a* and 108*b* extend horizontally outwardly from slidable member 86 and include a vertical hole passing therethrough for receiving a shank portion of cranks 98*a* and 98*b*, respectively. Thus, an upper portion of cranks 98*a* and 98*b* are rotatably supported by bearing members 108*a* and 108*b*. Cranks 98*a*, 98*b* include a pair of thrust washers 110*a*, 110*b* and 110*c*, 110*d*, respectively. Thrust washer 110*a* is positioned around the shank portion of crank 98*a*, above bearing member 108*a*, and adjacent to an upper surface of bearing member 108*a*. Thrust washer 110*b* is positioned around the shank portion of crank 98*a*, below bearing member 108*a*, and adjacent a lower surface of bearing member 108*a*. Thrust washer 110*c* is positioned around the shank portion of crank 98*b*, above bearing member 108*b*, and adjacent to an upper surface of bearing member 108*b*. Thrust washer 110*d* is positioned around the shank portion of crank 98*b*, below bearing member 108*b*, and adjacent a lower surface of bearing member 108*a*. The thrust washers 110*a–d* are then secured to their respective cranks, preferably by welding the thrust washers to the shank of the respective crank.

Referring back to FIG. 4A, the material leveling height of sled 80 is adjusted by individually rotating cranks 98*a*, 98*b*, 98*c* and 98*d* to increase or decrease the distance between the top of frame 82 and the bottom of adjustable support 84.

Although the road repair system described above includes directing device 30, material flow control device 40, and leveling device 80, certain aspects of the invention may be practiced separately from other aspects of the invention. For example, directing device 30, material flow control device 40 or leveling device 80 may be used independently from each other. Likewise, directing device 30 and material flow control device 40 together may be used independently from leveling device 80. Also, leveling device 80 may be used separately from directing device 30 and material flow control device 40.

Figure 5:
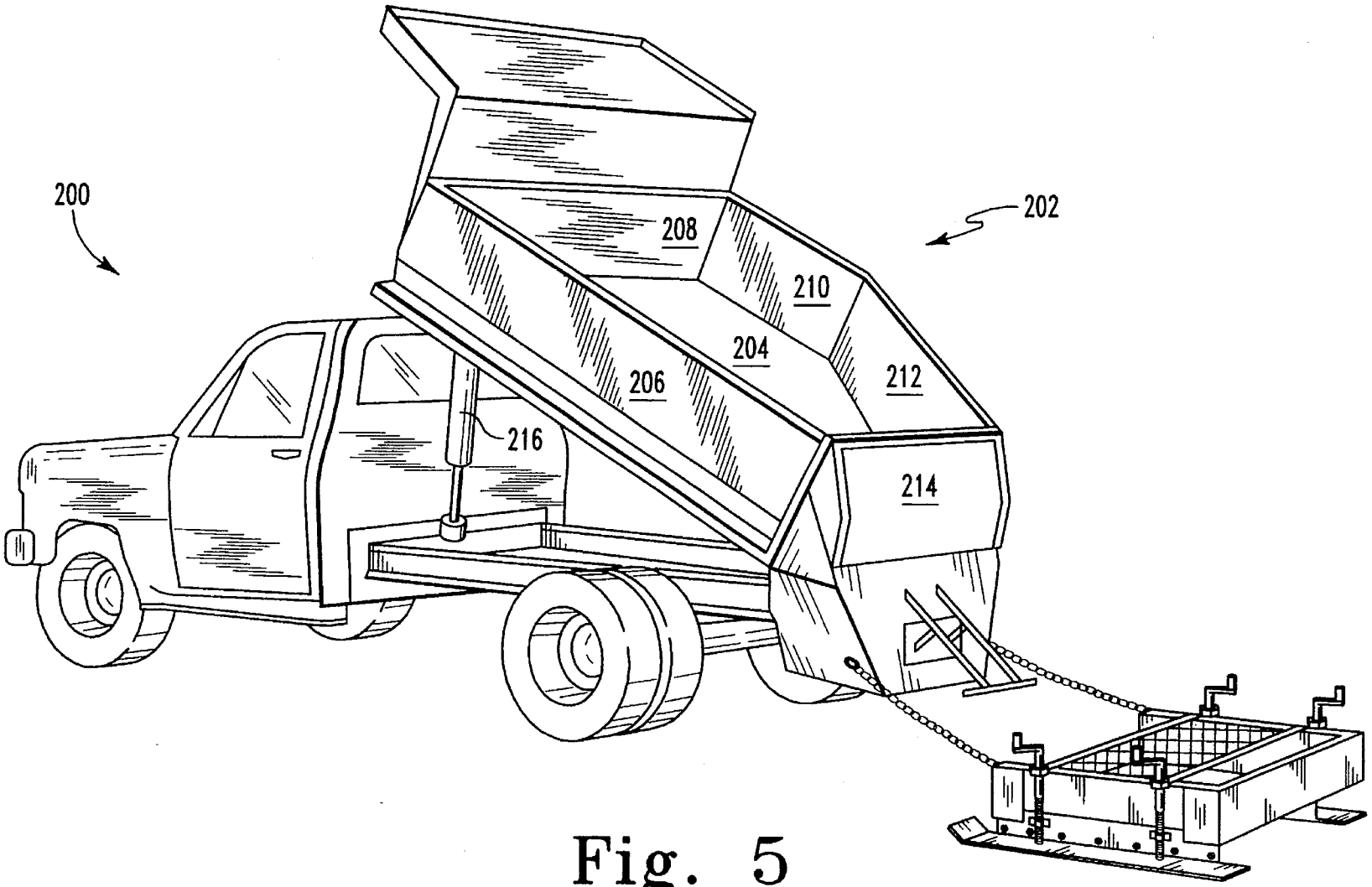
FIG. 5 shows another embodiment of the invention in which the directing device of the invention is incorporated into the structure of the dump bed.

FIG. 5 shows another embodiment of the invention in which a dump truck 200 includes a bed 202 incorporating baffle 32 of FIG. 1 into the side-wall structure of bed 202. Bed 202 forms a containment region for carrying road repairing material and is defined by a floor 204 and five panels 206, 208, 210, 212, and 214 defining a polygonal structure extending upwardly from floor 204. Panel 214 is moveable to provide an outlet for the material carried in bed 202 when bed 202 is hoisted by a hydraulic system, which includes a hydraulic cylinder 216. Panel 212 is positioned at an obtuse angle with respect to the moveable panel 214. Panel 212 is also positioned at an obtuse angle respect to panel 210.

The operation of the road repairing system and apparatus shown in FIG. 5 is identical in all material respects to the invention described above and shown in FIGS. 1–4B. It should be noted, however, that bed 200 cannot be converted to a conventional dump bed without considerable remanufacturing, whereas directing device 30 of FIG. 1 can be easily and quickly removed from bed 12 to allow bed 12 to resume its function as a conventional dump bed.

As an alternative to mounting hopper 40 to the frame of trucks 10 and 200, beds 12 and 202 may include the mounting system shown in FIGS. 3A and 3B so that hopper 40 may be coupled directly to beds 12 and 202.

Although the present invention has been described with reference to preferred embodiments, workers skilled in the art will recognize that changes may be made in form and detail without departing from the spirit and scope of the following claims.

I claim:

1. A system for use with a vehicle having a bed having a floor and a plurality of walls defining a containment region for carrying a material and having a moveable panel defining an outlet in said bed for dispensing material to a surface, comprising:

directing means positioned in said bed for directing said material to a portion of said outlet as gravitational force acts on said material to cause movement of said material when a front portion of said bed is raised with respect to a rear portion of said bed;

a receptacle mounted to said vehicle for receiving said material passing through said portion of said outlet and having means for varying a size of an opening in said receptacle for controllably dispensing a variable amount of said material received by said receptacle; and leveling means coupled to said vehicle for leveling said dispensed material.

2. The system of claim 1 wherein said directing means comprises a baffle mounted in said bed extending upwardly from said floor of said bed, and extending from a region of said moveable panel to a region of one of said plurality of walls of said bed to direct said material to said portion of said outlet as gravitational force acts on said material when said front portion of said bed is raised with respect to said rear portion of said bed.

3. The system of claim 2 wherein said baffle comprises a metal plate.

4. The system of claim 1 wherein said bed defines a containment region comprising said floor, a first side wall, a second side wall, a front wall extending between a front portion of said first side wall and a front portion of said second side wall, and said moveable panel extending horizontally between a rear portion of said first side wall and a rear portion of said second side wall, wherein each of said walls extends upwardly from said floor, and wherein said direction means comprises a baffle positioned in said bed extending upwardly from said floor of said bed and extending from a region of said moveable panel to a region of said first side wall.

5. The system of claim 1 wherein said directing means comprises a baffle extending outwardly from a wall of said bed and extending upwardly from a floor of said bed wherein said baffle, said side, said moveable panel and said floor define a volume in said bed substantially void of said material.

6. The system of claim 5 wherein a shape of a cross-section of said volume taken substantially parallel to said floor of said bed is substantially triangular.

7. The system of claim 1 wherein said receptacle comprises a tappered hopper for receiving a flow of said material passing through said portion of said outlet.

8. The system of claim 7 wherein said hopper comprises:

a receptacle having a plurality of sides and having an opening formed in a lower portion of one of said plurality of sides;

a moveable plate;

a pair of guides mounted on opposing sides of said opening for receiving said moveable plate; and actuation means for moving said moveable plate, whereby moving said moveable panel varies the size of said opening.

9. The system of claim 1 wherein said leveling means comprises a sled having an adjusting mechanism for selecting a leveling height of said material above said surface.

10. The system of claim 9 wherein said sled comprises:

a first side member;

a second side member;

a rear member extending horizontally between a rear portion of each of said side members;

a first elongated support adjustably coupled to said first side member; and a second elongated support adjustably coupled to said second side member.

11. The apparatus of claim 10 wherein said sled further comprises a platform coupled to said first and second side members for supporting an operator.

12. The system of claim 1 wherein said leveling means comprises:

a first side member;

a second side member;

a rear member extending horizontally between a rear portion of each of said side members;

a first elongated support adjustably coupled to said first side member;

a second elongated support adjustably coupled to said second side member; and a platform coupled to said first and second side members for supporting an operator, said first side member and said second side member defining an opening for receiving said material after said material reaches said surface.

13. An apparatus for use with a vehicle having a dump bed for carrying a material and having a moveable panel defining an outlet in said dump bed for dispensing material carried in said dump bed when said dump bed is raised, comprising:

a baffle positioned in said dump bed extending upwardly from a floor of said bed, and extending from a region of said moveable panel to a region of a wall of said bed for directing said material to a portion of said outlet as gravitational force acts on said material when said dump bed is raised; and a receptacle mounted to said vehicle for receiving a flow of said material passing through said portion of said outlet and having a variable opening for dispensing variable amounts of said material to a surface.

14. An apparatus for use with a vehicle having a bed for carrying a material and having a moveable panel defining an outlet in said bed for dispensing material, comprising a receptacle mounted to said vehicle for receiving said material passing through said outlet and having an opening of variable size for dispensing a variable amount of said material through said variable opening.

15. The apparatus of claim 13 wherein said control device comprises a receptacle having a variable opening for dispensing a controlled amount of said material to said surface.

16. An apparatus to be pulled by a vehicle for leveling a material dispensed to a surface, comprising:

a first side member;

a second side member;

a cross-member extending between a front portion of each of said side members;

a rear member extending horizontally between a rear portion of each of said side members, said first and second side members, said cross member and side rear member forming a frame;

a first elongated support adjustably coupled to said first side member;

a second elongated support adjustably coupled to said second side member; and adjusting means coupled between said first side member and said first elongated support and coupled between said second side member and said second elongated support for varying a distance between a top of said frame and a bottom of said first elongated support and for varying a distance between the top of said frame and a bottom of said second elongated support to thereby adjust a height and orientation of said rear member with respect to said surface.

* * * * *